US005360208A

United States Patent [19]

Fang

[11] Patent Number: 5,360,208

[45] Date of Patent: Nov. 1, 1994

[54] STRUCTURE OF BASKETBALL RIM HOOP RING

[76] Inventor: Yao-Chien Fang, Ste. 1, 11F, No. 95-8, Chang Ping Road Sec. 1, Taichung, Taiwan, Prov. of China

[21] Appl. No.: 126,555

[22] Filed: Sep. 27, 1993

[51] Int. Cl.[5] ..... A63B 63/08

[52] U.S. Cl. ..... 273/1.5 R

[58] Field of Search ..... 273/1.5 R, 1.5 A; 43/11, 134

[56] References Cited

U.S. PATENT DOCUMENTS

| | | | |
|---|---|---|---|
| 1,387,418 | 8/1921 | Lillibridge | 273/1.5 R |
| 1,520,196 | 12/1924 | Medart et al. | 273/1.5 R |
| 1,544,453 | 6/1925 | Harbison | 273/1.5 R |
| 2,783,573 | 3/1957 | Rau | 43/11 |
| 2,969,984 | 1/1961 | Presnick | 273/73 L X |
| 4,169,331 | 10/1979 | Baker | 43/11 |
| 4,805,903 | 2/1989 | McArdle | 273/1.5 R |
| 4,834,368 | 5/1989 | Qualley | 43/11 X |
| 4,903,964 | 2/1990 | Anderson | 273/1.5 R |
| 4,905,995 | 3/1990 | Apo | 273/1.5 R |
| 5,098,091 | 3/1992 | McGivern | 273/1.5 R |

FOREIGN PATENT DOCUMENTS

| | | | |
|---|---|---|---|
| 942313 | 9/1948 | France | 43/11 |
| 411905 | 7/1945 | Italy | 43/11 |
| 1553077 | 9/1979 | United Kingdom | 273/1.5 R |

*Primary Examiner*—Paul E. Shapiro

[57] ABSTRACT

A basketball hoop has generally a circular ring shaped rim having an inverted U-shape groove on the underside with a plurality of pairs of the protrusions around the lower edge of the groove and a circular ring having a narrow gap at a circumference attachable to the rim. A basketball net may be mounted firstly on the ring and then the ring via the gap may be snapped between the pairs of the protrusions into the groove for releasably securing the net to the rim. This protects the net from being directly hit by a basket ball when in shooting and facilitates ready mounting or dismounting of the net to the rim.

1 Claim, 3 Drawing Sheets

STRUCTURE OF BASKETBALL RIM HOOP RING

BACKGROUND OF THE INVENTION

The present invention relates to the basketball goals, more particularly to a structurally improved basketball hoop which has a concaved rim and a circular ring having a narrow gap therethrough its circumference for securing a basket net to the rim in a snap fitting.

Prior art basketball goal comprises generally a single circular hoop attached to a backboard for directly securing a basket net thereon. This hook-on type basket hoop, though the structure is simple and handly has some disadvantages outlined as follows:

a) the net that directly mounts to the rim thereon is liable to be impacted by the backetball while shooting in the net therefore leads to extremely damage the net. It is not affordable to the users if frequently changes the net, b) it is difficult to maintain an outdoor basketball net of the hook-on type without frequent replacement and it is uneconomical if frequent changes to a new net are required, and c ) when the hook-on type basketball hoop is being used by children or taller persons, the hook on the rim will potentially endanger the players, leading to a possibility of injury as the hoop is lower then the height of the player's hand in contrast.

SUMMARY OF THE PRESENT INVENTION

The present invention has a main object to provide a basketball hoop which is composed of a concaved rim and an attachable circular ring having a narrow gap therein for releasably securing a basketball net to the rim in a snap fitting.

Another objeect of the present invention is to provide a basketball hoop for facilitating a ready assembly or disassembly of a basketball net to the, rim of a basketball hoop in order that the net to be replaceable.

Accordingly, the basketball hoop of the present invention comprises generally circular ring shaped rim and an attachable circular ring thereof.

The ring has an inverted U-shape groove in the lateral cross section at each point about the rim and a connection means for mounting the rim to a backboard thereon.

The groove has a plurality of pairs of transversely spaced apart, opposed, inwardly facing protrusions on the inner side of each leg adjacent the lower edge of the groove defining a gap between each pair of the protrusions.

The circular ring has a narrow gap extended transversely therethrough at one point in its circumference, a median diameter equal to that of the rim, a maximum width in transverse cross section smaller than that of the groove and slightly greater than the gap between the pair of protrusions and a maximum height no greater than the depth of the groove. The narrow gap is formed for passing portions of a basketball net therethrough.

Whereby, a net may be mounted on the circular ring and snapped between the pairs of the protrusions into the groove in order to secure the net to the rim.

This invention will become more fully understood by reference to the following detailed description thereof when read in accompanying with the attached drawings.

DETAIL DESCRIPTION OF THE PREFERRED EMBODIMENT OF THE PRESENT INVENTION

Figure 1:
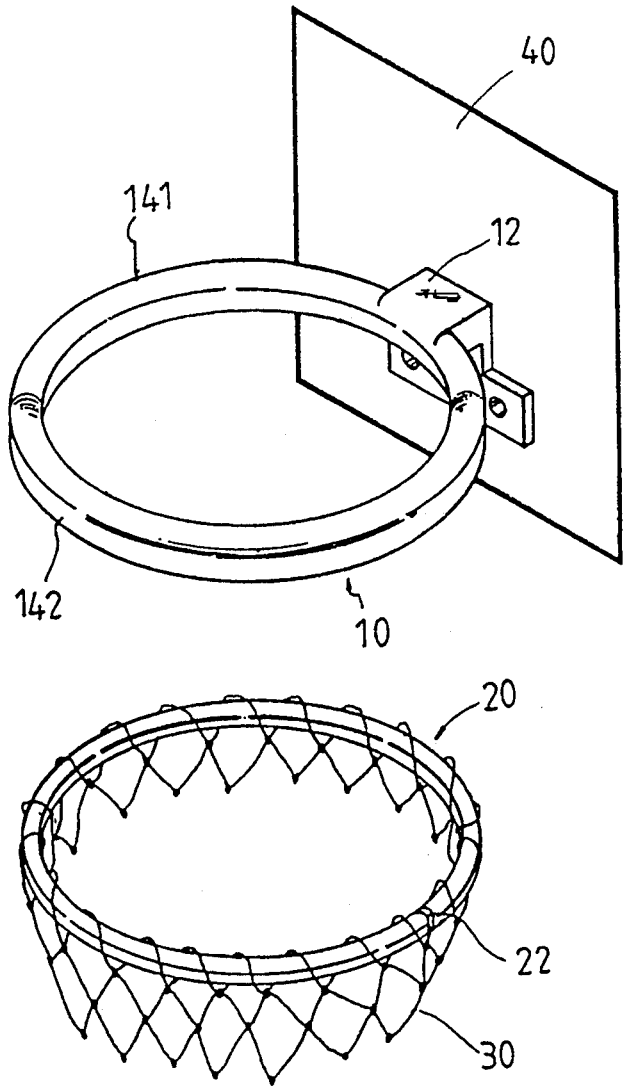
FIG. 1 is perspective view to show the preferred embodiment according to the present invention.

Referring to FIGS. 1 to 4 of the drawings, a structurally improved basketball hoop comprises generally a circular ring shaped rim 10 and a circular ring 20 attachable to the rim 10 therein.

The rim 10 has a connection means 12 secured to a circumference thereof for mounting itself to a backboard 40 thereon and an annular groove 14 in an inverted U-shape lateral cross section at each point about the rim 10 defining a convex upper rim surface 141 formd by the bail of the U-shape, a pair of downwardly extended and spaced apart legs 142 by the sides of the U-shape and plurality of pairs of the fransversely spaced apart opposed, inwardly facing protrusions 143 on the inner side of each leg 142 adjacent the lower edges of the legs 142. The pairs of the protrusions 143 are generally uniformly circumferentially spaced from each other about the rim 10 and define between each pair of them a gap slightly narrower than the width of the groove 14.

Figure 2:
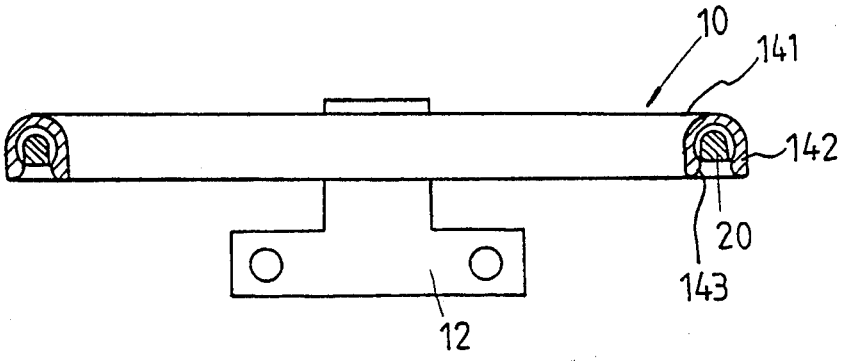
FIG. 2 is an elevational section view to show a circular ring attached to the rim therein according to the present invention.
Figure 4:
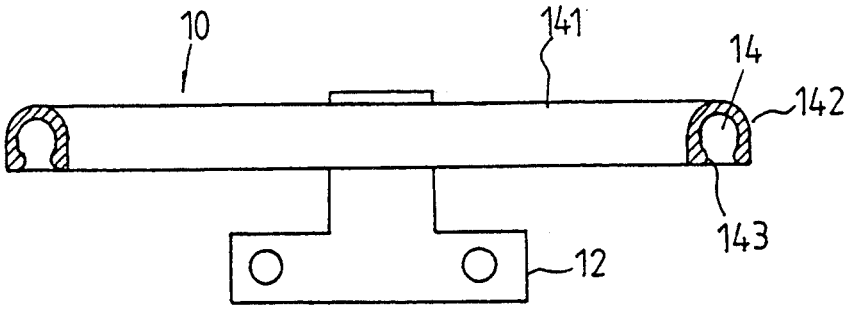
FIG. 4 is an elevational section of FIG. 3.
Figure 3:
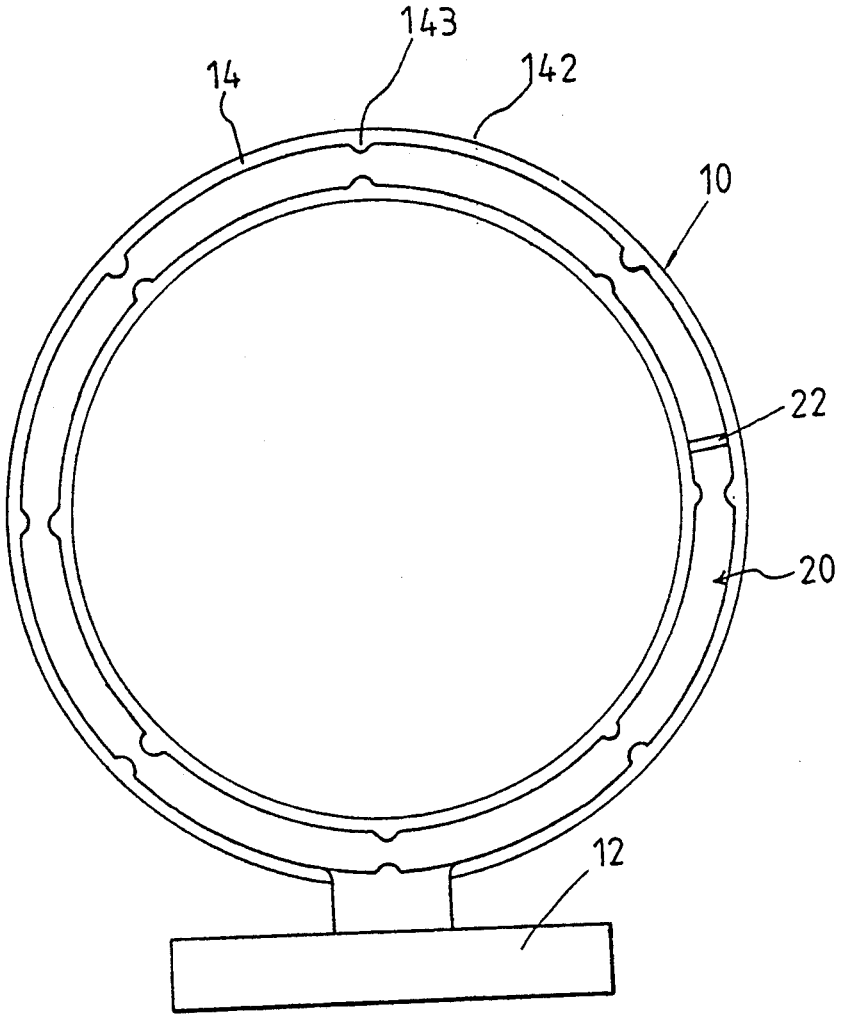
FIG. 3 is a bottom view to show the basketball hoop of the present invention.

The circular ring 20 which has a narrow gap 22 extended transversely therethough at a point in its circumference for passing portion of a basketball net 30, has a round upper surface, a flat bottom surface, a maximum width in transverse cross section smaller than the width of the groove 14 and slightly greater than the gap between each pair of the protrusions 143, and a maximum height no greater than the depth of the groove 14 (shown in FIGS. 1 and 2).

Furthermore, the rim 10 and the circular ring 20 have same mediam diameter so as to facilitate a suitable engagement of the ring 20 into the rim 10.

When mounting a basketball net 30 onto the hoop a user first mounts an upper edge of the net 30 onto the circular ring 20 via the gap 22, then snaps the ring 20 between the pairs of the protrusions 143 into the groove 14 so as to securely and releasably attach the net 30 to the rim 10 (shown in FIGS. 1 and 2). To disengage the ring 20 with the rim 10 it is merely necessary for a use to hold the lower portion of the basketball net 30 and to tug the ring 20 out of the groove 14 in the rim 10.

Based on aforediscussed embodiment, the basketball hoop of the present invention provides numerous features and advantages outlined as follows a) the net which is protected in the groove will prevent it from being directly hit by a basket ball when shooting so as to increase the longevity of the net, b) if the basketball hoop is located at a outdoor court, the net may be mounted or dismounted frequently upon the begining or end of each game or a tournament so as to prevent the net from being worm off by the open-air, and c) since no hook is required to mount the basketball net of the present invention, it provides a sense of beauty and also prevents the players from being endangered by the hook.

Note that the specification relates to the above embodiment should be construed as to exemplary rather than as limitative of the person invention, with many variations and modification being readily attainable by a person of average skill in the art without aparting from the spirit or scope thereof as defined by the appended claims and their legal equivalents.

I claim:

1. A basketball hoop comprising, a) a circular ring shaped rim having an inverted U-shape in lateral cross section at each point about the rim, said inverted U-shape defining a convex upper rim surface formed by the bail of the U-shape and a pair of downwardly extending space apart legs defined by the sides of the U-shape, and forming a downwardly opening groove under the upper surface and between the legs, said groove having a first width and depth, b) a plurality of pairs of transversely space apart, opposed, inwardly facing protrusions on the inner sides of each leg adjacent the lower edges of the legs, said pairs of protrusions being generally uniformly circumferentially spaced from each other about the rim and defining between the protrusions of each pair a gap having a second width, c) means secured to said rim for mounting said rim to a backboard, d) a circular ring having a narrow gap extending transversely therethrough at one point in its circumference for passing portions of a backetball net therethrough for mounting such net to the ring, said ring having a maximum width in transverse cross section smaller than said first width and slightly greater than second width and a maximum height no greater than the depth of the groove, e) said rim and said ring having the same median diameter, whereby a net may be mounted on said ring and said ring may be snapped between said protrusions into said groove to secure said net to said rim.

* * * * *